US006810996B2

(12) United States Patent
Rump

(10) Patent No.: US 6,810,996 B2
(45) Date of Patent: Nov. 2, 2004

(54) BRACKET FOR A SAWHORSE AND OTHER MULTIPLE PIECE STANDS

(76) Inventor: Brian D. Rump, 109 NE. 18th Pl., Cape Coral, FL (US) 33909

( * ) Notice: Subject to any disclaimer, the term of this patent is extended or adjusted under 35 U.S.C. 154(b) by 0 days.

(21) Appl. No.: 09/849,032

(22) Filed: May 4, 2001

(65) Prior Publication Data

US 2002/0162704 A1 Nov. 7, 2002

(51) Int. Cl.[7] ..... E04G 1/00; E04G 1/34
(52) U.S. Cl. ..... 182/186.5; 182/153; 182/224
(58) Field of Search ..... 182/153, 151, 182/181.1, 225, 224, 182.4, 155, 186.5, 186.2, 186.1

(56) References Cited

U.S. PATENT DOCUMENTS 3,289,789 A * 12/1966 Larson ..... 182/153
3,329,239 A * 7/1967 Chesney ..... 182/153
3,530,956 A * 9/1970 Jadek ..... 182/153
4,325,463 A * 4/1982 Taylor ..... 182/155
5,125,478 A * 6/1992 Henningsen ..... 182/153

* cited by examiner

*Primary Examiner*—Hugh B. Thompson, II
(74) *Attorney, Agent, or Firm*—William E. Noonan

(57) ABSTRACT

A bracket is provided for a sawhorse or other multiple piece stand, which stand includes a plurality of elongate legs and an elongate beam supported substantially horizontally by the legs. The bracket includes a generally U-shaped channel for receiving the beam. The channel includes a base and pair of side walls attached unitarily to and extending upwardly from the base. There are a pair of leg accommodating receptacles fixedly joined to the channel and including a first receptacle that has a first recess for fixedly interengaging the base and a first one of the side walls of the channel and a second receptacle that has a second recess for fixedly interengaging the base and a second one of the side walls of the channel. The receptacles are juxtaposed along and extend divergently from the channel. Each receptacle is capable of receiving a respective leg, which legs are engaged with a substantially horizontal surface to support the beam above the substantially horizontal surface.

9 Claims, 4 Drawing Sheets

BRACKET FOR A SAWHORSE AND OTHER MULTIPLE PIECE STANDS

FIELD OF THE INVENTION

This invention relates to a bracket for use in a sawhorse, roadside barricade or other multiple piece stand.

BACKGROUND OF THE INVENTION

Wooden sawhorses have been used by carpenters and others in the construction industry for many years. Normally, these devices are manufactured by simply nailing together a number of 2×4's or other wooden components. One of the components forms a horizontal beam and typically 2 pairs of diverging legs are attached to depend from the beam. These types of sawhorses are usually constructed in a fairly hurried manner on the job site and oftentimes do not provide satisfactory support. Such sawhorses are apt to collapse under heavy and/or shifting loads.

Various brackets have been developed to facilitate and improve sawhorse assembly. These products feature a fairly intricate and complicated construction. In many cases, they are designed so that the sawhorse is able to collapse. See, for example, U.S. Pat. Nos. 4,461,370, 4,238,001, 4,730,698 and 5,779,003. Due to the collapsibility of these products, they are apt to be somewhat weaker than is desirable. The hinged interconnections of the brackets are usually not able to withstand heavy loads, which are often encountered in the construction industry. Moreover, although collapsibility is sometimes a desirable feature, hinged brackets provide the sawhorse with less than optimal stability.

SUMMARY OF THE INVENTION

It is therefore an object of the present invention to provide an improved bracket for providing a more stable, supportive and durable sawhorse.

It is a further object of this invention to provide a strong, rugged sawhorse bracket that enables the sawhorse to stability and securely support very large weights.

It is a further object of this invention to provide a sawhorse bracket that permits a sawhorse to be assembled quickly and effectively on a job site.

It is a further object of this invention to provide a sawhorse bracket that is convenient to transport between work locations.

It is a further object of this invention to provide a sawhorse bracket that permits the sawhorse to be quickly and conveniently disassembled when use of the sawhorse is no longer required.

It is a further object of this invention to provide a sawhorse bracket that evenly and effectively distributes the weight of a load supported by the sawhorse.

It is a further object of this invention to provide a sawhorse bracket that employs a simple and easy to manufacture design, without moving parts.

It is a further object of this invention to provide a bracket that may be used effectively in the assembly of roadside barricades and other support stands.

This invention results from a realization that an improved bracket for a sawhorse and other types of support stands may be accomplished by mounting a longitudinal beam between a pair of brackets, each of which includes a U-shaped channel that receives a portion of the beam. The invention results from the further realization that an even stronger and more stable bracket is achieved by employing a pair of diverging leg accommodating receptacles that are juxtaposed along and fixed to each channel. Each receptacle is provided with a recess that is fixedly engaged with both a base of the channel and a respective upturned side wall of the channel. In this manner, the weight of the object supported on the beam is distributed evenly through the diverging leg accommodating receptacles and into the legs of the sawhorse.

This invention features a bracket for a sawhorse or other multiple piece stand, which stand includes a plurality of elongate legs and an elongate beam supported substantially horizontally by the legs. The bracket includes a generally U-shaped channel for receiving the beam. The channel includes a base and a pair of side walls attached unitarily to and extending upwardly from the base. There are a pair of leg accommodating receptacles fixedly joined to the channel. A first receptacle has a first recess that fixedly interengages the base and the first one of the side walls of the channel. A second receptacle has a second recess that fixedly interengages the base and a second one of the side walls of the channel. The receptacles are juxtaposed along and extend divergently from the channel. Each receptacle is capable of receiving a respective leg, which legs are engaged with a substantially horizontal surface to support the beam above the surface.

In a preferred embodiment, the receptacles include respective tubular components. Each tubular component may have a generally rectangular cross sectional shape. The first recess may include a pair of substantially aligned notches in one of the tubular components, each of which fixedly interengages the base and the first side wall of the channel. The second recess may include a pair of substantially aligned notches in the other tubular component. Each such notch fixedly interengages the base and a second side wall of the channel. The channel and the tubular components may include respective longitudinal axes that are orientated at obtuse angles relative to one another.

The channel may include at least two holes for receiving a connector that is attachable to the beam. Likewise, each receptacle may include at least one hole for receiving a connector that is attachable to the beam.

Preferably, a sawhorse is constructed by employing a pair of brackets as described above. The channel and the receptacles may be fixedly interconnected by welding the receptacles to the channel. Alternatively, the channels and the receptacle may feature a one piece, molded plastic construction.

DETAILED DESCRIPTION OF PREFERRED EMBODIMENTS

Other objects, features and advantages will occur from the following description of a preferred embodiment and the accompanying drawings, in which.

Figure 1:
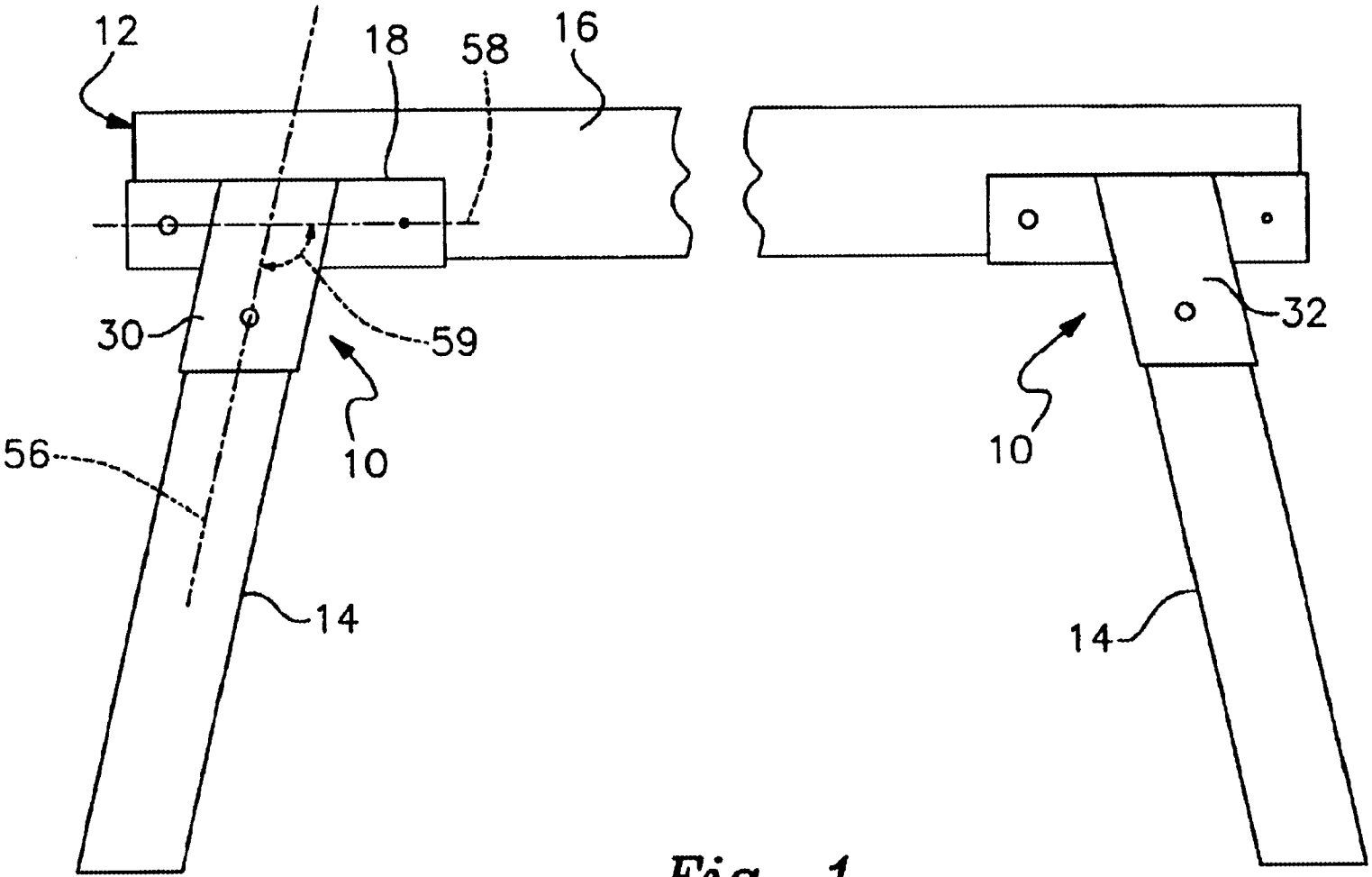
FIG. 1 is an elevational side view of a sawhorse that employs a pair of brackets in accordance with this invention.

There is shown in FIG. 1 a pair of sawhorse brackets 10 incorporated as part of an assembled sawhorse 12. The sawhorse is designed to be utilized in a known manner in various applications in the carpentry and construction industries. Sawhorse 12 may also be utilized for residential home improvements and other noncommercial applications. Each bracket 10 interconnects a pair of diverging support legs 14 (only one leg is shown with each bracket in FIG. 1) to a horizontal beam 16. The legs 14 and beam 16 typically comprise elongate wood or plastic elements (e.g. wood 2×4's). Sawhorse 12 is used either alone or in combination with other sawhorses to support lumber, drywall, or other loads in a known manner.

Figure 2:
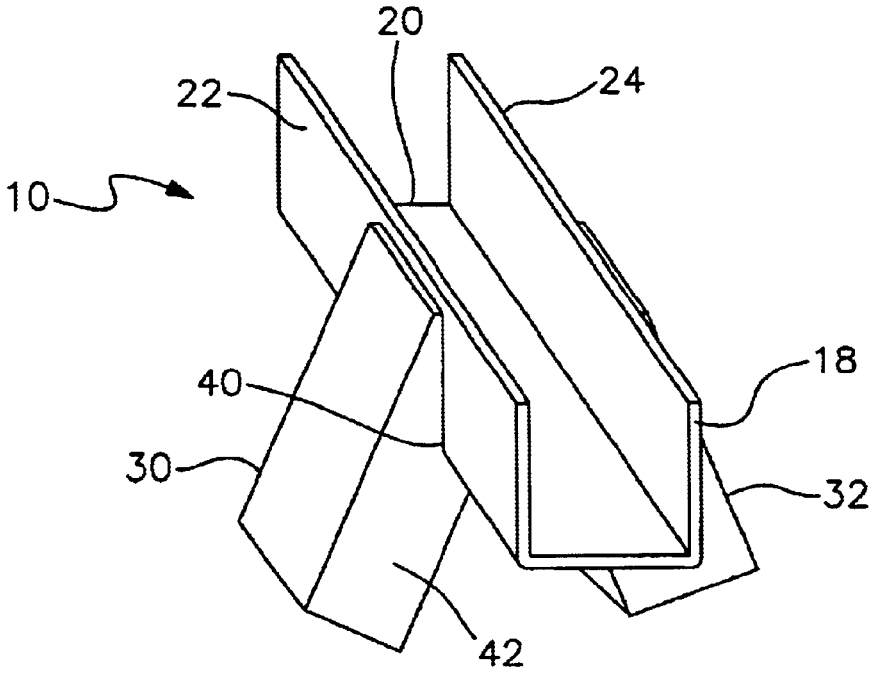
FIG. 2 is a top perspective view of a representative one of the sawhorse brackets in accordance with this invention.
Figure 4:
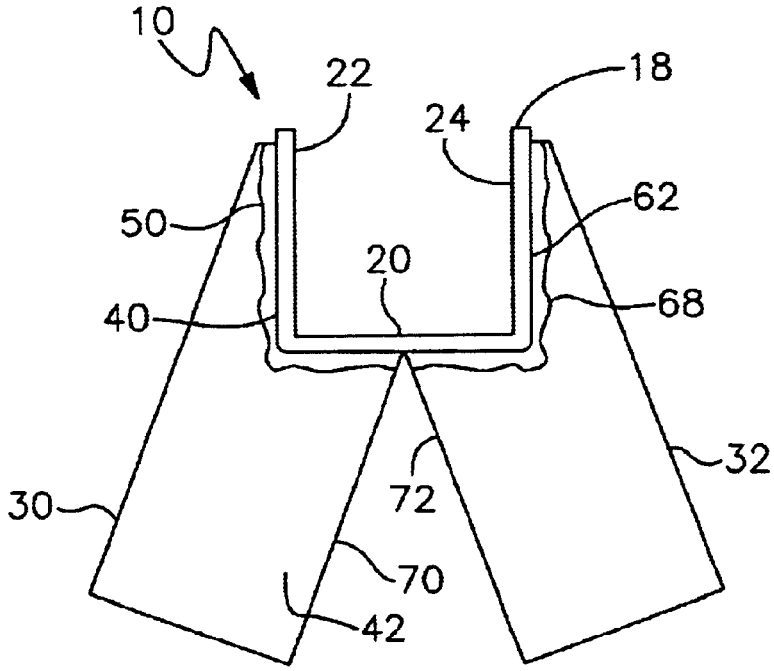
FIG. 4 is an elevational end view of the sawhorse bracket.
Figure 3:
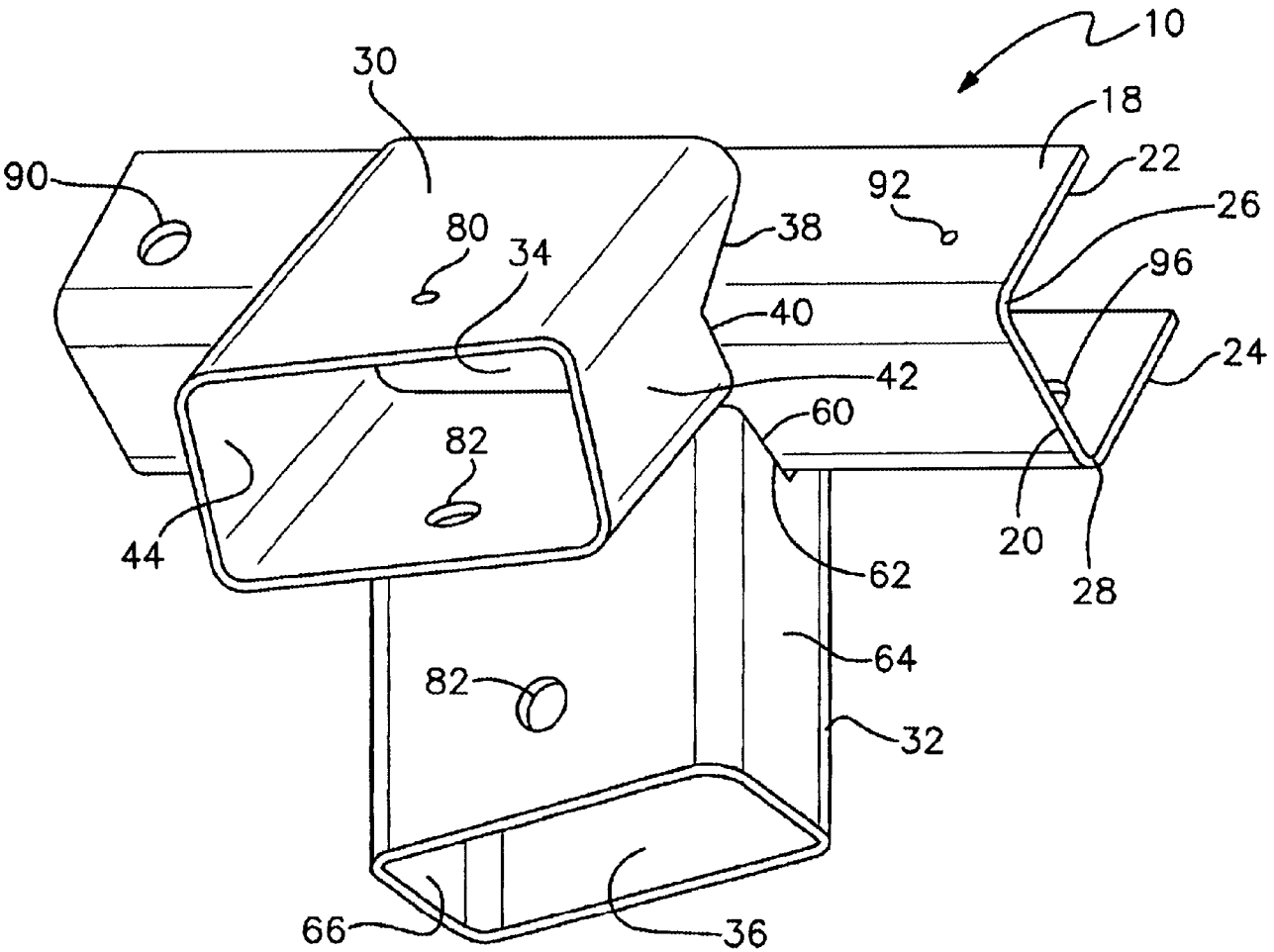
FIG. 3 is a bottom perspective view of the sawhorse bracket.

A representative support bracket 10 is illustrated in FIGS. 2–4. The bracket includes an elongate steel channel 18, which has a generally U-shaped cross sectional configuration. The U-shaped channel may be formed using various known manufacturing techniques. In particular, channel 18 includes a flat base 20 and upturned side walls 22 and 24 that are unitarily interconnected to and extend upwardly from opposing longitudinal sides of base 20. As best shown in FIG. 3, the junctions 26 and 28 between base 20 and the respective side walls 22 and 24 may be slightly rounded. The length of channel 18 may be varied within the scope of this invention.

A diverging pair of leg accommodating sockets or receptacles 30 and 32 are fixedly joined to channel 18 between the longitudinal ends of the channel. Receptacles 30 and 32 comprise rectangular tubular components that are preferably composed of steel or other material similar to that composing channel 18. Once again, as best shown in FIG. 3, the corners of rectangular receptacles 30 and 32 may be slightly rounded. Each of the tubular components has a respective opening 34, that is slightly larger than the leg component that the tubular component is designed to receive. As previously indicated, the leg component may comprise a 2×4 wood member.

Figure 5:
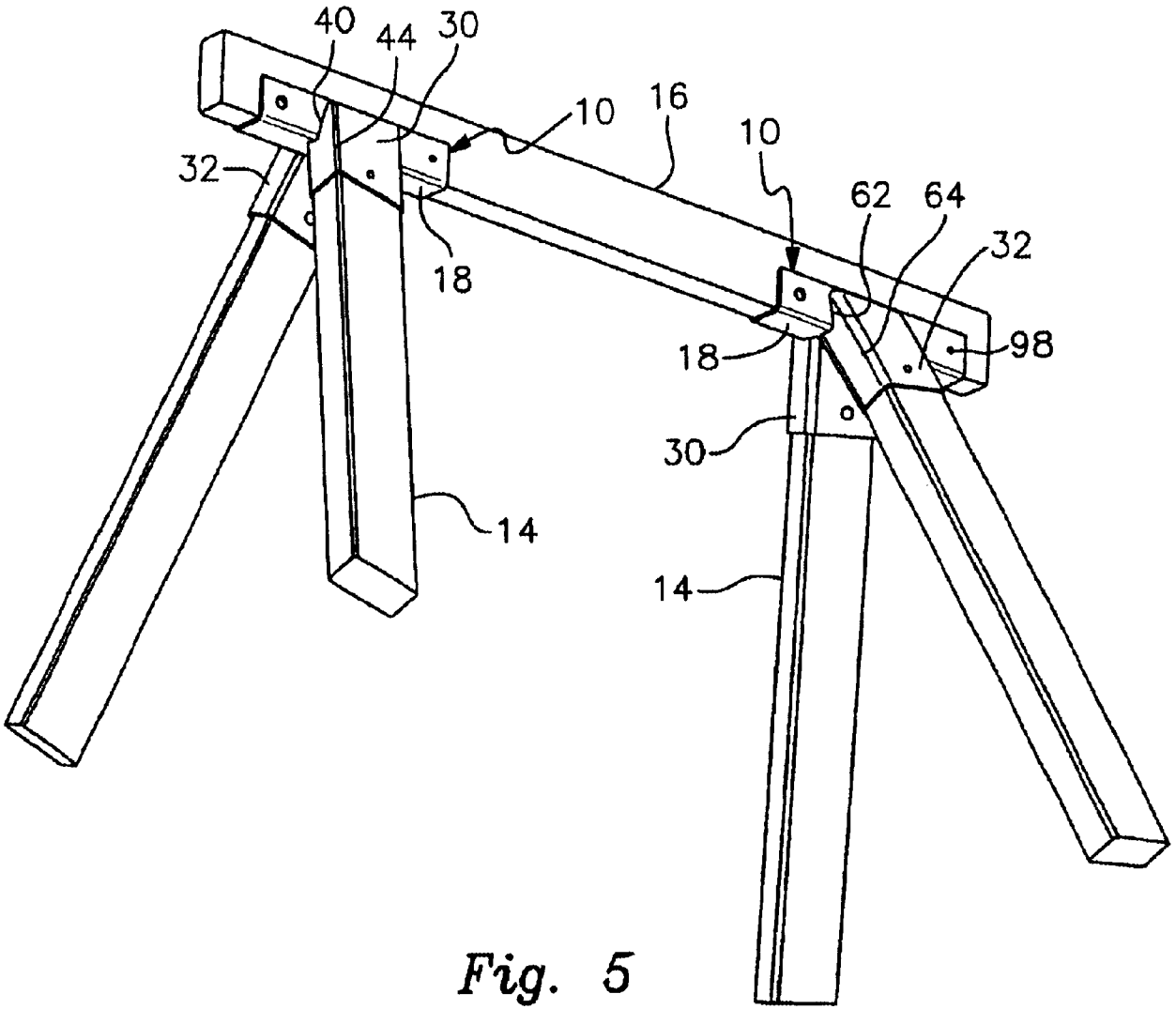
FIG. 5 is a bottom perspective view of the assembled sawhorse.

The tubular components are fixedly joined to channel 18 in a manner that significantly enhances the strength and stability of bracket 10. In particular, each tubular receptacle includes an upper recess that conformably engages channel 18. In particular, component 30 includes a recess 38 comprising an aligned pair of generally V-shaped notches 40 formed in opposing walls 42 and 44 of component 30. In FIGS. 2–4, only the notch 40 formed in wall 42 is shown. A like notch is formed in wall 44 (FIG. 3) but that notch is obscured from view in FIGS. 2–4. However, the notch 40 on wall 44 is shown in FIG. 5. Each of the notches 40 engages both the outside surface of channel side wall 22 and the lower surface of base 20. In fact, notch 40 engages side wall 22 for most if not the entire height of the side wall. The notch extends across slightly less than half of the width of the base. Receptacle 30 is permanently fixed to channel 18 by welding or otherwise fastening the receptacle to the channel along the edges of the notches 40. See weld 50 in FIG. 4. As a result, the notches 40 of recess 38 fixedly interengage side wall 22 and base 20 such that receptacle 30 is rigidly and permanently joined to the channel. The notches are formed in the receptacle at an orientation such that receptacle 30 an attached leg 14 (FIG. 1) depend downwardly from channel 18 at an angle as shown in FIGS. 2–4.

As shown in FIG. 1, leg accommodating receptacle 30 is cut transversely at an angle such that when it is permanently attached to channel 18 there is an obtuse angle 59 between the longitudinal axis 56 of tubular component 30 and the longitudinal axis 58 of channel 18.

Leg accommodating receptacle 32, FIGS. 1–4, is permanently secured to channel 18 in an analogous manner. Receptacle 32 is juxtaposed beside receptacle 30 and, when attached to channel 18, diverges from receptacle 30 in the manner shown in FIGS. 2–4. Receptacle 32 includes a recess 60, FIG. 3, which again comprises a pair of aligned generally V-shaped notches 62 formed in opposing walls 64 and 66 of receptacle 32. Each of notches 62 interengages the outside surface of side wall 24 and the lower surface of base 20 of channel 18. Once again, a weld 68 is formed between the notch edges of receptacle 32 and channel 18. This fixedly fastens the receptacle to the channel. Notch 62 is orientated so that receptacle 32 diverges from channel 18 at an angle similar to, but opposing that of receptacle 30. Once again, each of the notches of receptacle 32 extends for virtually the entire height of side wall 24 and for slightly less than half the width of base 20. As best shown in FIG. 4, there is little, if any, space formed between the inside walls 70 and 72 of diverging receptacles 30 and 32, respectively. As a result of the foregoing construction, the weight or force of a supported load exerted upon channel 18 is distributed evenly through the base and side walls of the channel into the diverging receptacle 30 and 32. As previously described for receptacle 30, receptacle 32 is attached to channel 18 such that the axis of the receptacle forms an obtuse angle with the longitudinal axis of the channel. See FIG. 1.

As shown in FIGS. 1 and 5, a pair of brackets 10, as previously described, are used to assembly sawhorse 10 proximate respective ends of horizontal beam 16. Each tubular receptacle 30 and 32 of each bracket 10 receives a respective wood leg 14. The upper end of leg 14 fits snugly and securely within its associated receptacle opening. The length of the leg may be varied widely within the scope of this invention.

Each of the receptacles includes an opposing pair of nail or screw holes 80 and 82 formed in opposing walls thereof. These holes receive nails or screws which securely fasten a respective wooden leg within the receptacle. The screw or nail is inserted through the smaller opening 80 and is driven in a known manner through the leg received therein. The tip of the nail or screw is allowed to protrude through the aligned larger hole 82.

Similar slots or holes are provided within channel 18 for fastening the longitudinal beam within the channel. For example, as best shown in FIGS. 3 and 5, side wall 22 includes a large hole 90 proximate one end and a small hole 92 proximate the other end. Conversely, side wall 24 includes a large hole 96 aligned with hole 92 and a smaller hole 98 (FIG. 5 only) that is aligned with hole 90. Once again, a nail or screw is driven first through the smaller hole 92 and then through the beam received within the channel. A tip of the nail or screw protrudes through the aligned larger hole 96. As a result, the beam is securely fastened within the channel.

Sawhorse 10 may be assembled by first inserting the legs into receptacles 30 and 32 in each of two brackets 10. The channels 18 of the two brackets 10 are then aligned and a beam 16 is inserted into the aligned channels. The brackets are fastened to the inserted legs and beam by nails or screws as described above. It will be obvious to those skilled in the art that this operation may be varied within the scope of this invention (i.e. the beam may be attached first and the legs last).

A bracket that employs the construction described herein exhibits a number of advantages over known sawhorse brackets. As described, the leg accommodating receptacles interengage the channel such that the channel is supported for virtually the entire height of each side wall and across virtually the entire width of the base. This permits the weight of the load supported on the sawhorse to be distributed evenly through the channel to the receptacles and the attached legs. Improved stability and strength are thereby achieved. The bracket is far stronger and more supportive than most known sawhorse assembly techniques.

Additionally, the rigidly fixed interconnection between the receptacles and the channel provides significant advantages. Because the receptacles are not hingedly connected to the channel, weak points and product failure are avoided. The assembled sawhorse is able to support much larger weights in a much more stable fashion than is possible using known sawhorse brackets. Because the longitudinal axes of the tubular receptacles form obtuse angles with the beam accommodating channel, an even stronger stable support is provided.

When sawhorse 12 is no longer in use, it can be quickly and conveniently disassembled by simply removing the nails and screws from the bracket and detaching the legs and horizontal beam. The brackets are then transported to a storage facility or another job site and reused as required in the foregoing manner.

Brackets 10 may also be conveniently used on a wide variety of alternative support stands such as road barricades, signs, work benches, etc. In each case, the rigid interengagement between the channel and the receptacles provides the brackets, and therefore the stand, with improved strength and stability. The channel and permanently connected receptacles may be formed of a molded plastic or other durable and impact resistant materials. It should also be understood that the elements used for the beams and the legs in the sawhorse may be composed of plastic, metal or other alternative materials.

From the foregoing it may be seen that the apparatus of this invention provides for a bracket for use in a stronger and more stable and supportive sawhorse, roadside barricade or other multiple piece stand. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

Other embodiments will occur to those skilled in the art and are within the following claims:

What is claimed is:

1. A bracket for a multiple piece stand, which stand includes a plurality of elongate legs and an elongate beam supported on a substantially horizontal surface by the legs, said bracket comprising:

a substantially rigid and one piece, generally U-shaped channel for receiving the beam, said channel including a base and a pair of side walls attached unitarily to and extending upwardly from said base, said base comprising an elongate, one piece element that is substantially rigid and substantially planar and each said side wall comprising an elongate, substantially rigid and substantially planar component, said base and said side walls including respective interior surfaces that are substantially flat and smooth for conformably receiving and interengaging the elongate beam; and a pair of leg accommodating receptacles comprising respective tubular components that are fixedly and rigidly interconnected to one another through said channel, said receptacles including a first receptacle fixedly joined to said channel and having a first recess for interengaging said base and a first one of said side walls of said channel, and a second receptacle fixedly joined to said channel and having a second recess for interengaging said base and a second one of the side walls of said channel, said first and second receptacles being juxtaposed along and extending divergently from said channel at a fixed angle relative to one another, each receptacle being capable of receiving a respective leg, which legs are engagable with the substantially horizontal surface to support the beam above the substantially horizontal surface, said first recess including a pair of substantially aligned notches, each of which respectively fixedly interengages said base and a first side wall of said channel.

2. The bracket of claim 1 in which each of said tubular components has a generally rectangular cross sectional shape.

3. The bracket of claim 1 in which said second recess includes a pair of substantially aligned notches, each of which respectively fixedly interengages said base and said side wall of said channel.

4. The bracket of claim 1 in which said channel and said tubular components include respective longitudinal axes that are oriented at obtuse angles relative to one another.

5. The bracket of claim 1 in which said channel includes at least two holes for receiving a connector that is attachable to the beam.

6. The bracket of claim 1 in which each receptacle includes at least one hole for receiving a connector that is attachable to the leg received by the receptacle.

7. The bracket of claim 1 in which said channel comprises an elongate one-piece component that extends longitudinally beyond said leg accommodating receptacles.

8. The system of claim 1 in which said channel is structurally distinct from said receptacles and said recesses, said channel being interengaged with said receptacles respectively through said recesses.

9. A bracket system for a multiple piece stand, which stand includes a plurality of elongate legs and an elongate beam supported on a substantially horizontal surface by the legs, said bracket system comprising:

a first bracket including a substantially rigid first channel for receiving the beam, said first channel including a first base and a first pair of side walls attached unitarily to and extending upwardly from said first base, and a first pair of leg accommodating receptacles fixedly and rigidly interconnected to one another through said first channel including a first receptacle that has a first recess for interengaging said base and one of said side walls of said first channel and a second receptacle that has a second recess for interengaging said base and the other of said side walls of said first channel, said first and second receptacles of said first bracket being juxtaposed along and extending divergently from said first channel at a fixed angle relative to one another, and a second bracket including a substantially rigid second channel for receiving the beam, said second channel including a second base and a second pair of side walls attached unitarily to and extending upwardly from said second base, and a second pair of leg accommodating receptacles fixedly and rigidly interconnected to one another through said second channel and including a third receptacle that has a third recess for interengaging said second base and one of said side walls of said second channel and a fourth receptacle that has a fourth recess for interengaging said second base and the other side wall of said second channel, said third and fourth receptacles of said second bracket being juxtaposed along and extending divergently from said second channel at a fixed angle relative to one another;

each of said receptacles of said first and second brackets being capable of receiving a respective leg, which legs are engagable with the substantially horizontal surface to support the beam above the substantially horizontal surface;

said base and said side walls of each channel having substantially flat and smooth interior surfaces for receiving and conformably engaging the elongate beam, each said channel comprising a one-piece fixedly shaped construction, said receptacles comprising respective tubular components, each said recess including a pair of substantially aligned notches, each of which respectively fixedly interengages said base and a first side wall of said channel.

* * * * *